United States Patent [19]

Kita et al.

[11] Patent Number: 5,023,670

[45] Date of Patent: Jun. 11, 1991

[54] DEVELOPING APPARATUS HAVING DEVELOPING UNITS WITH A SLIDING MEMBER CONTACTING A GUIDE MEMBER

[75] Inventors: Hideki Kita, Suita; Akira Nakakuma, Takaishi; Hidehiro Fukui, Hirakata; Hiroyuki Deguchi, Osaka, all of Japan

[73] Assignee: Mita Industrial Co., Ltd., Japan

[21] Appl. No.: 544,429

[22] Filed: Jun. 27, 1990

[30] Foreign Application Priority Data

Jun. 30, 1989 [JP] Japan ..... 1-170858

[51] Int. Cl.[5] ..... G03G 15/01

[52] U.S. Cl. ..... 355/326; 355/211; 355/245; 355/327

[58] Field of Search ..... 355/211, 212, 245, 259, 355/326, 327, 210; 118/645, 656

[56] References Cited

U.S. PATENT DOCUMENTS 4,258,372 3/1981 Ishikawa ..... 355/245

4,841,329 6/1989 Kasamura et al. ..... 355/326 X

*Primary Examiner*—A. T. Grimley

*Assistant Examiner*—Christopher Horgan

*Attorney, Agent, or Firm*—Beveridge, DeGrandi & Weilacher

[57] ABSTRACT

Guided through a sliding member by a guide member set before a photoreceptor, a plurality of developing units approach the photoreceptor in turn and face the photoreceptor, thereby to develop, at an open portion of the guide member with being projected by an enforcing member.

15 Claims, 6 Drawing Sheets

DEVELOPING APPARATUS HAVING DEVELOPING UNITS WITH A SLIDING MEMBER CONTACTING A GUIDE MEMBER

BACKGROUND OF THE INVENTION

1. Field of the Invention

The present invention relates to a developing apparatus having a plurality of developing units for use in a color copying machine and the like.

2. Description of the Related Art

As to a conventional color developing apparatus, there is known a way of developing each color to move a plurality of developing units. FIG. 1 is a schematic side view for describing the operation of such a conventional color developing apparatus. In FIG. 1, with each of developing units 200 being moved in turn towards a photoreceptor 4, when one of units 200 is situated in front of the photoreceptor 4, cam 400 is driven by a driving means so that a sleeve 300 set in the developing unit 200 is brought close to the photoreceptor 4 while keeping a certain distance, then development is performed. After that development, another one of units 200 is moved in front of the photoreceptor 4 and is brought close to the photoreceptor 4 by means of the cam 400, in the same manner as above, for development in another color.

In such a way of developing, however, there are some problems because the precise positioning of the developing unit 200 by means of driving the cam 400 causes the structure of the developing apparatus to be complex and expensive.

SUMMARY OF THE INVENTION

It is an object of the present invention to solve such problems in the prior art.

That is, an object of the present invention is to provide a developing apparatus comprising:

a plurality of developing units, each of which, being in one row and always enforced towards a photoreceptor by enforcing means, has a developing roller for conveying a toner to a latent image on said photoreceptor, a sliding member which is set in each of said developing units, a guide member for guiding said developing units, touching said sliding member, and having at least one open portion into which said sliding member moves when said photoreceptor and one of said developing units face each other during developing, and driving means for moving said developing units. In the structure of the present invention described above, the developing units are moved in turn by being pushed against the guide member, using the sliding member. At the place the photoreceptor and a developing unit face, where there is an open portion of the guide member, a developing roller set in the developing unit projects towards the side of the photoreceptor by the forcing means. Therefore, the developing roller approaches the photoreceptor and then development is operated. In this way, it is possible to move the developing units in turn towards the photoreceptor without using a cam. Moreover, owing to the guide member, the developing roller does not get close to the photoreceptor except for the part of it near the photoreceptor, to prevent image determination caused by toner scattering.

Furthermore, proper use of the roller as a sliding member enables precise positioning to be easy.

DESCRIPTION OF THE PREFERRED EMBODIMENTS

Figure 1:
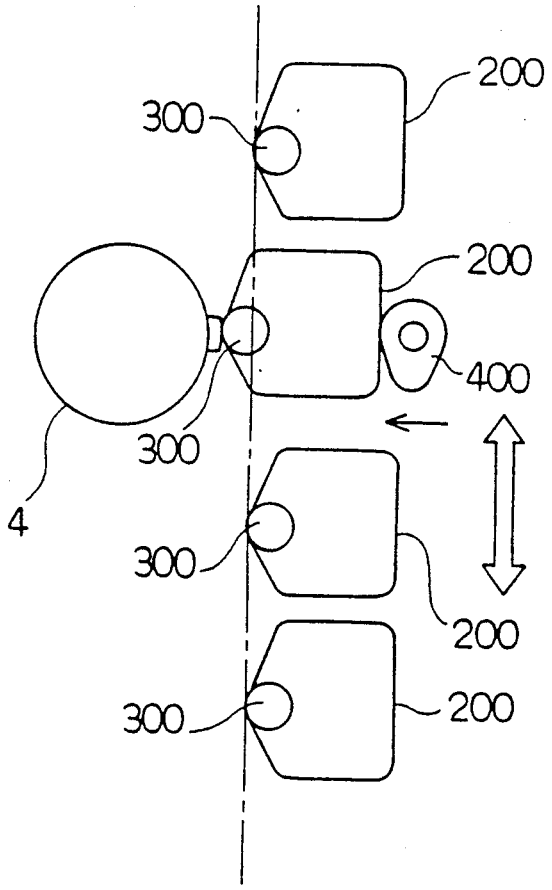
FIG. 1 (PRIOR ART)
FIG. 1 is a schematic section view of a conventional developing apparatus.
Figure 2:
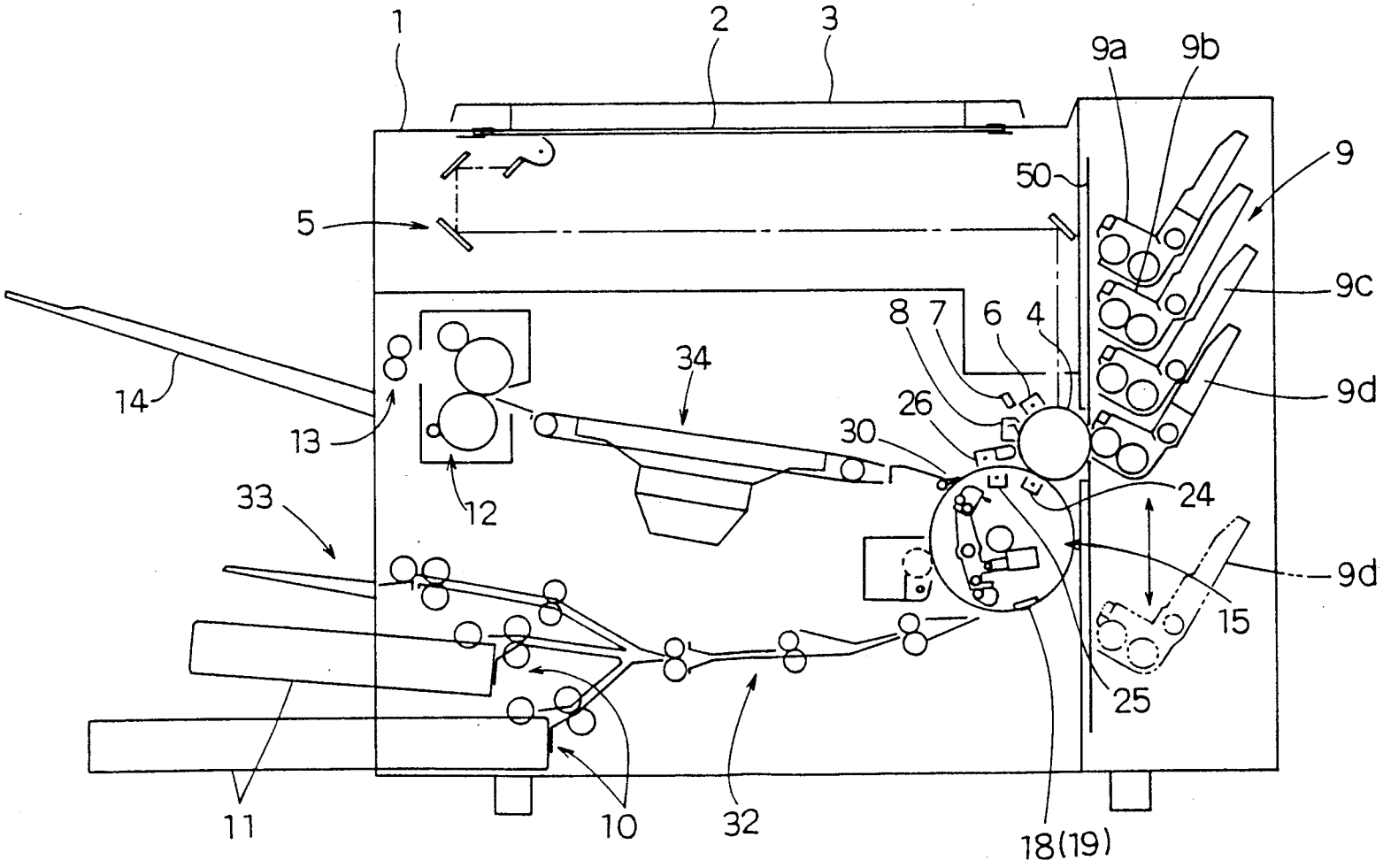
FIG. 2 is a schematic section view of a color copying machine which uses one embodiment of a developing apparatus in accordance with the present invention.

With reference to the drawings, description for embodiments of the present invention is as follows:

FIG. 2 is a schematic section view showing a color copying machine which has a plurality of developing units.

In this drawing, an original glass plate 2 for placing an original is on the top of a copying machine body 1, whereon an original cover 3 is set. Inside of the copying machine body 1 there is a photoreceptor 4, such as a semiconductor photoconductive layer and so on. An optical system 5 comprises a lamp for lighting up the original and a reflecting mirror for guiding its reflection to the photoreceptor 4 and other members. An electric charger 6 for charging the photoreceptor 4, an electric discharger 7 for discharging an electric charge on the photoreceptor 4, a cleaning unit 8 for removing the residual toner on the photoreceptor 4, four developing units 9*a*, 9*b*, 9*c* and 9*d*, and separators 25, 26 for separating papers are placed around the photoreceptor 4, respectively. Besides, at the bottom of the copying machine body 1, there are paper feed rollers 10 and cassettes 11 for keeping paper, and above them there is a fixing apparatus 12. By the side of the fixing apparatus 12, a document exit roller 13 and a document exit tray 14 are set. A transfer device 15 is positioned beneath the photoreceptor 4. Reference numeral 24 indicates an electric charger for transfer, 25 an electric charger for separation and 18 (19), a clip for clipping transfer paper. Numeral 30 identifies a separating claw, 32 a transfer guide path, 33 a manual paper feed tray and 34 a transport path.

The developing units 9 mentioned above are described in detail below.

Figure 3:
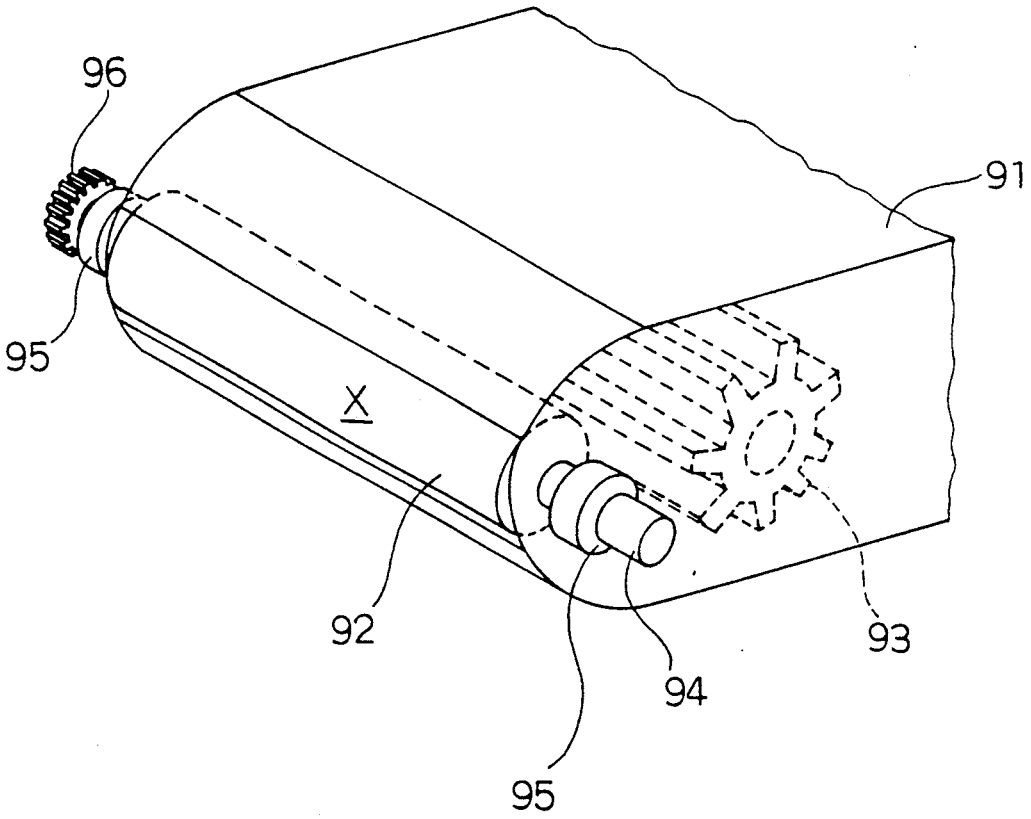
FIG. 3 is a partial perspective view of the embodiment of FIG. 2.
Figure 4:
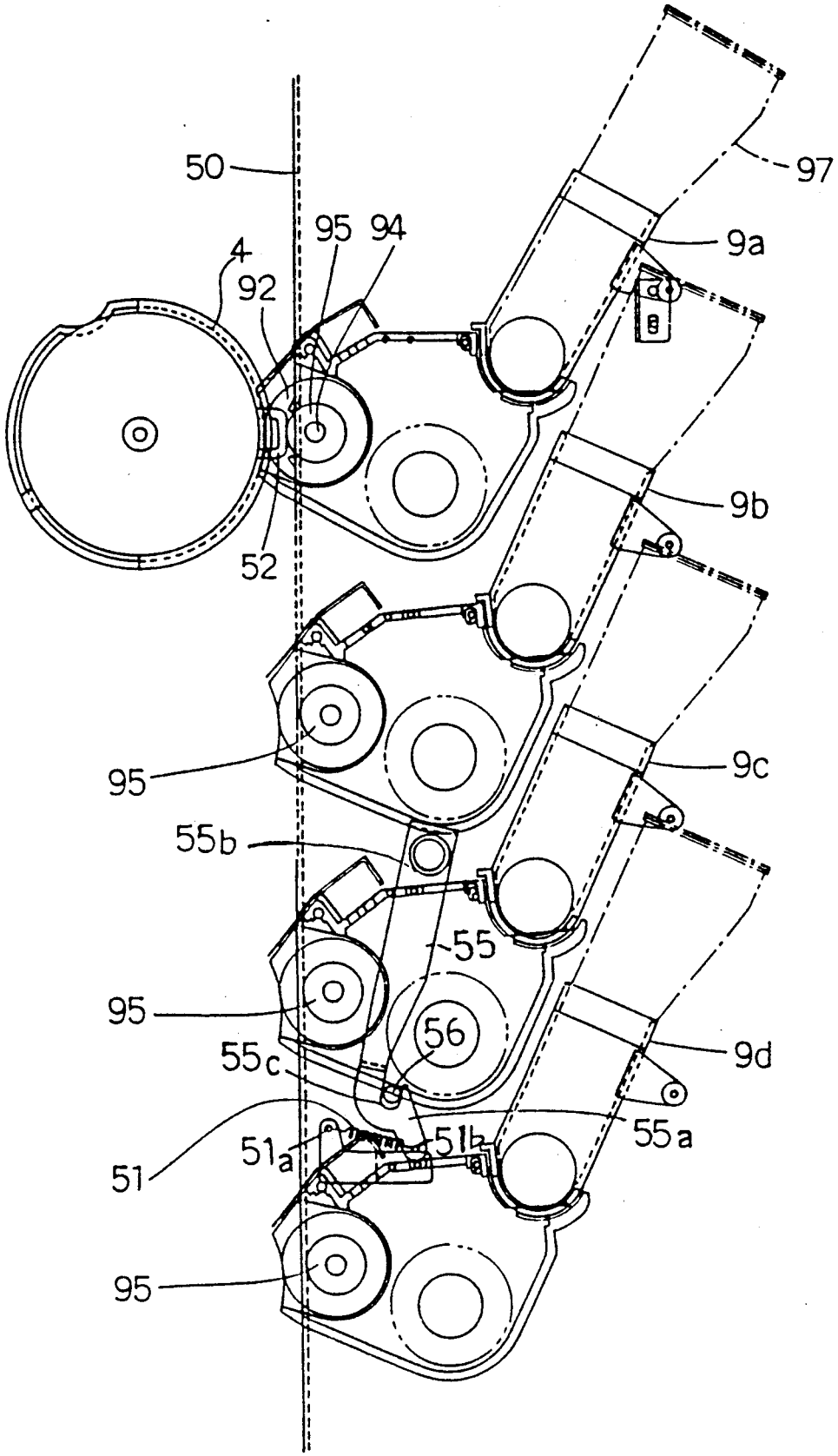
FIG. 4 is a schematic section view of the embodiment of FIG. 2.

FIG. 3 is a partial perspective view showing the front part of one of the developing units 9. FIG. 4 is a side view of it showing the relation between each one of the developing units 9 and the photoreceptor 4.

The front part of each of units 9 comprises a developing housing 91 which has a window X, i.e. an open portion, at its tip end, a sleeve 92 partially projecting itself from the window X, as one example for the developing roller, a stirring roller 93 for stirring the toner, and the like. As a sliding member, a roller 95 is attached to each end of the sleeve 92. Numeral 94 identifies a shaft of the developing roller 92, thereupon a driving gear 96 is fixed.

These four developing units 9*a*, 9*b*, 9*c* and 9*d* in the case of this embodiment are, as shown in FIG. 4, arranged vertically in a line and movable upwards and downwards (Ref. one-dotted chain line in FIG. 2) by being held by a developing unit frame (not shown). Numeral 97 indicates a toner hopper of the developing units 9.

The developing units 9 are always forced towards the photoreceptor 4 by the forcing means 51, such as a spring 51. That is, in FIG. 4, one end 51*a* of the spring 51 is fixed to the above-mentioned developing unit frame and the other end 51*b* is linked to a lower part 55*a* of a lever 55. The lever 55 pivots, at its upper part 55*b*, on the developing unit frame. And a hook 55*c* is formed at the lower part 55*a* of the lever 55. A pin 56 fixed to the developing unit 9*c*, is linked to the hook 55*c*. As a result, the developing unit 9*c* is forced towards the photoreceptor 4 by the spring 51 through the lever 55. Then as to the other developing units 9*a*, 9*b*, 9*d*, they are similarly forced towards the photoreceptor 4 by springs not shown in FIG. 4.

Figure 5:
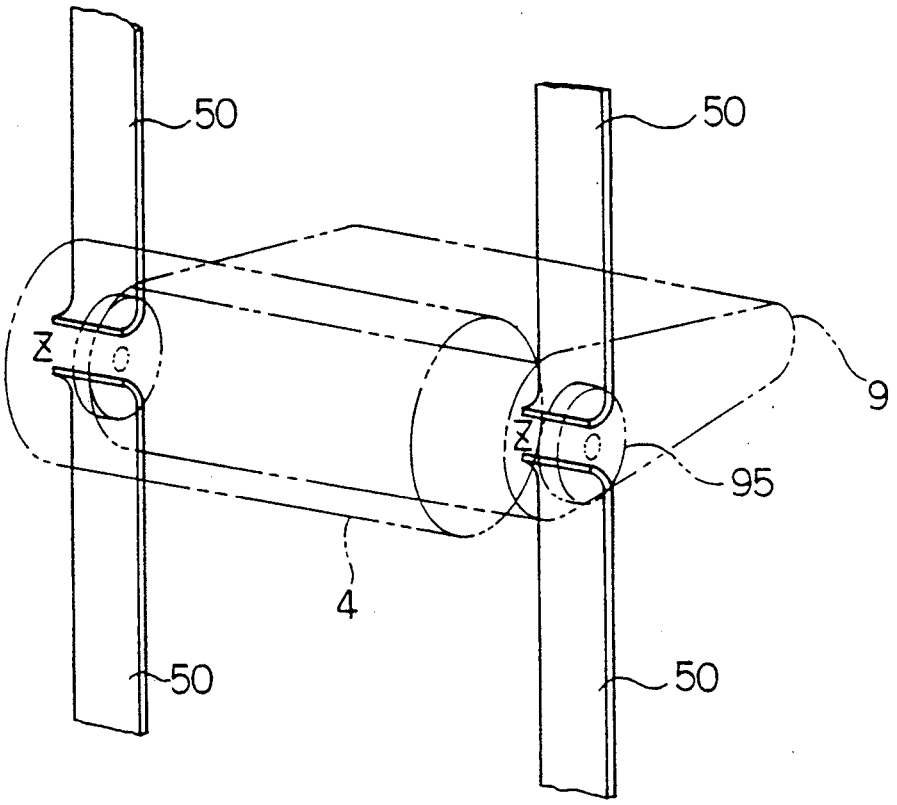
FIG. 5 is a perspective view of the embodiment of FIG. 2.
Figure 6:
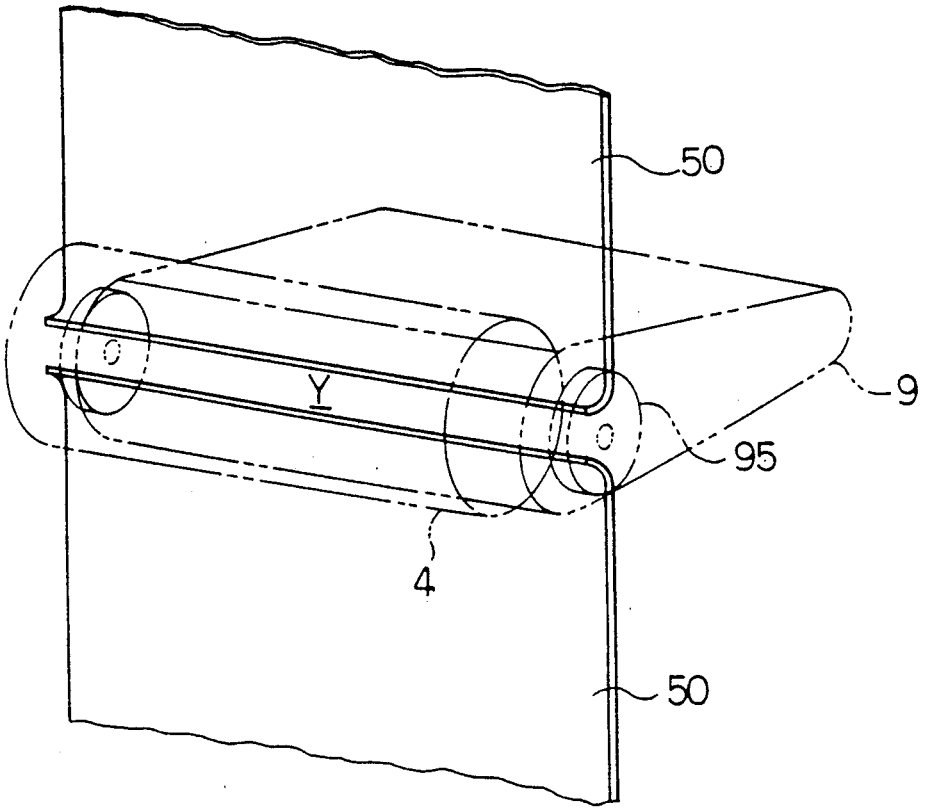
FIG. 6 is a perspective view of another embodiment of the developing apparatus in accordance with the present invention.

The guide member 50 exists between the photoreceptor 4 and the developing units 9. One type of guide member 50, as shown in FIG. 5, has two rail members, each of which has an open portion Z where the photoreceptor 4 and the developing unit 9 face each other during development and stands in the position corresponding to said roller 95. Another available type of the guide member 50, as shown in FIG. 6, consists of a kind of board which has at least one slit Y where the photoreceptor 4 and the developing unit 9 face each other during development.

Accordingly, since the rest of the developing units 9 not placed in the operative position, together with the photoreceptor 4 are forced towards the side of the photoreceptor 4 by the forcing means 51, the rollers 95 of three developing units 9*b*, 9*c* and 9*d* shown below in FIG. 4 touch the guide member 50. In the case of FIG. 4, the guide member 50 is of the two-rail type and then in that case, the developing units 9*b*, 9*c*, 9*d* and the photoreceptor 4 face each other without interception so that the diameter of the rollers 95 and the diameter of the developing roller 92 can be selected freely. However, in the case in which a board-like member is used as a guide member, there is a part of the guide member 50 intervening between one of the developing units 9 and the photoreceptor 4. Therefore, it is necessary to pay attention in order that the developing roller 92 should not touch the guide member 50 by setting the diameter of the rollers 95 longer than that of the developing roller 92.

The rollers 95 set in the developing unit 9*a* which is placed for a development operation with the photoreceptor 4 are, owing to the open portion Z or the slit Y in the guide member 50, projected towards the side of the photoreceptor 4 by the forcing means 51. In this case, consequently, the rollers 95 touch the positioning member such as at the right and left ends of the photoreceptor 4 which do not affect the formation of an image, an outside member of the photoreceptor 4, a member 52 fixed in the color copying machine, in a way that the rollers 95 serve to keep a certain distance from the surface of the developing roller 92 to the surface of the photoreceptor 4.

Figure 7:
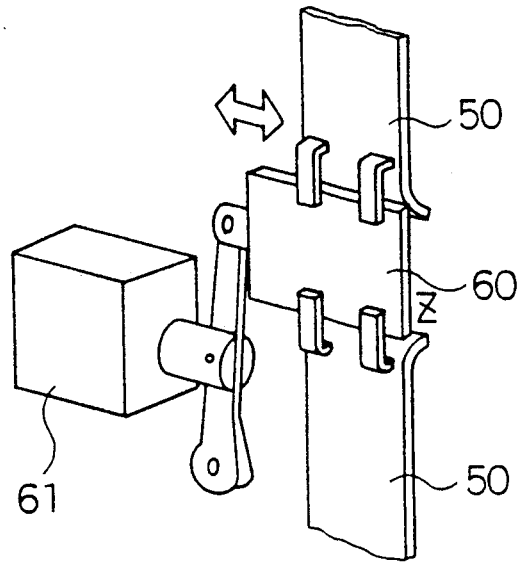
FIG. 7 is a perspective view of a shutter member in the embodiment of FIG. 6.

As shown in FIG. 7, it is possible to attach a movable shutter member 60 to the open portion Z or the slit Y in said guide member 50, thereby to open and close them. The shutter member 60 is slidably supported by the guide member 50 at the upper and lower sides of the shutter member 60 and is also movable towards both left and right sides by means of a solenoid 61 in order to open and close the open portion Z or the slit Y.

In operation the embodiment previously described does as follows:

First, development is started with all of the four developing units 9*a*, 9*b*, 9*c* and 9*d* being above the development position together with the photoreceptor 4. Next, each of these developing units 9*a*, 9*b*, 9*c* and 9*d* is moved downwards by means of a motor, wire and so on (not shown in the FIGS.) while forced onto the guide member 50 by the forcing means 51, and at that time the rollers 95 are also moved downwards, touching the guide member 50.

In this way, when the lowest developing unit 9*d* comes in front of the open portion Z or the slit Y, therefrom the roller 95 projects towards the side of the photoreceptor 4 by the enforcing means 51. Therefore, since the developing unit 9*d* is controlled by the guide member 50, the developing unit 9*d* does not get overly close to the photoreceptor 4 until the developing unit 9*d* comes to the position for development with the photoreceptor 4. As a result, deterioration in quality of an image caused by scattering of toner can be prevented.

According to that, the projecting roller 95 touches the member 52 attached to the photoreceptor 4, and therefore, the distance from the surface of the developing roller 92 to the surface of the photoreceptor 4 is strictly controlled.

In the next process, development is performed for a latent image which is formed on the photoreceptor 4 by the reflected light from the original, using the toner of the developing unit 9*d*. The latent toner image is, then, transferred to a sheet of paper sent from the cassette 11, by means of the transfer device 15. The residual toner is removed by the cleaning unit 8.

After that process, the developing units 9*a*, 9*b*, 9*c* and 9*d* are lowered by one rank, and afterwards, as mentioned before, the next developing unit 9*c* comes in front of the open portion Z or the slit Y, and then projects. After the positioning by the rollers 95 and the positioning member 52, development is performed, using the toner of the developing unit 9*c*.

In this stage, said transferred sheet comes to the position for transfer again, and then development in a different color is operated.

As to the developing units 9*b* and 9*a*, development is performed in the same way. When all of the developing units 9*a*, 9*b*, 9*c* and 9*d* are lowered below the photoreceptor 4 with development in all colors being finished, the open portion Z or the slit Y is closed by moving the shutter member 60 which is driven by the solenoid 61. Then, the developing units 9*a*, 9*b*, 9*c* and 9*d* are moved upwards and positioned where they start performing development. At that time, since the open portion Z or the slit Y is closed by the shutter member 60, there is no danger that the rollers 95 will get into the open portion Z or the slit Y during return to the starting position, and therefore, the developing units 9*a*, 9*b*, 9*c* and 9*d* can be returned at high speed.

In addition, arrangement of the developing units does not necessarily need to be in a line as shown in FIG.4, but a free arrangement, such as in an arc of a circle, is also available.

Furthermore, although the present embodiments are described for the case of a full color copying machine having four developing units, it is possible to use the present embodiment in any type of image forming apparatus which has at least two developing units.

Also, in the present embodiments, a roller is attached to each end of a developing roller as a sliding member, a roller can be attached to some part except for a developing roller, moreover, a projection can be used instead of the roller.

As described, in an image apparatus related to the present invention, owing to the roller and the guide member which guides the roller and has a open portion, each developing unit can be changed in a simple structure and the quality of an image can be prevented from deteriorating as a result of scattering of toner, because a developing unit which is not necessary for development for a time is placed away from a photoreceptor with enough distance.

It is further understood by those skilled in the art that the foregoing description is a preferred embodiment and that various changes and modifications may be made in the invention without departing from the spirit and scope thereof.

We claim:

1. A developing apparatus including a photoreceptor, said apparatus comprising:

a plurality of developing units which are aligned in one row, each developing unit having a developing roller for conveying toner to a latent image on said photoreceptor, forcing means for always forcing each developing unit towards the photoreceptor, a sliding member disposed in each of said developing units, a guide member for guiding said developing units, said guide member having at least one open portion wherein said photoreceptor and one of said developing units face each other during developing, said sliding members being forced into contact with said guide member under the force exerted by said forcing means for forcing said developing units towards said photoreceptor, driving means for moving said developing units along said guide member, one of said sliding members being moved into said open portion by said forcing means as said one sliding member reaches said open portion when said developing units are driven by said driving means, whereby one of said developing units is positioned near said photoreceptor, said guide member being formed so that said one sliding member moves out of said open portion against the force exerted by said forcing means as said one sliding member is driven away from said open portion when said developing units are driven by said driving means.

2. A developing apparatus in accordance with claim 1, wherein;

said one sliding member is projected towards a side of said photoreceptor at said open portion of said guide member by said forcing means and touches a positioning member on said photoreceptor in order to maintain a suitable distance between said developing roller and said photoreceptor.

3. A developing apparatus in accordance with claim 2, wherein, said sliding members each comprise a roller rotatably attached to each end of each of said developing units.

4. A developing apparatus in accordance with claim 3, wherein;

said roller rotates about an axis of said developing roller.

5. A developing apparatus in accordance with claim 4, wherein;

said positioning member is an end of said photoreceptor which is not involved in image formation.

6. A developing apparatus in accordance with claim 4, wherein;

said positioning member is an outside member of said photoreceptor.

7. A developing apparatus in accordance with claim 4, wherein;

said positioning member is fixed to an apparatus to which said photoreceptor is installed.

8. A developing apparatus in accordance with claim 4, wherein;

said open portion of said guide member is freely opened and closed by means of a shutter member.

9. A developing apparatus in accordance with claim 8, wherein;

said shutter member is opened when said developing units move for developing, and is closed when said developing units move for returning to a start position.

10. A developing apparatus in accordance with claim 4, wherein;

said guide member comprises two rails which each have an open portion at a location wherein said photoreceptor and said developing unit face each other.

11. A developing apparatus in accordance with claim 4, wherein;

said guide member comprises a board which has at least a slit at a location wherein said photoreceptor and said developing unit face each other.

12. A developing apparatus in accordance with claim 1, wherein;

said open portion of said guide member is freely opened and closed by means of a shutter member.

13. A developing apparatus in accordance with claim 12, wherein;

said shutter member is opened when said developing units move for developing, and is closed when said developing units move for returning to a start position.

14. A developing apparatus in accordance with claim 13, wherein;

said guide member comprises two rails which each having an open portion at a location wherein said photoreceptor and said developing unit face each other.

15. A developing apparatus in accordance with claim 13, wherein;

said guide member comprises a board which has at least a slit at a location wherein said photoreceptor and said developing unit face each other.

* * * * *